US007178974B1

(12) United States Patent
Bell

(10) Patent No.: US 7,178,974 B1
(45) Date of Patent: Feb. 20, 2007

(54) PLURAL COMPONENT POLYMER GROUT PLANT

(76) Inventor: Marcus O. Bell, 1900 Harry Lemons Rd., Mandeville, LA (US) 70448

( * ) Notice: Subject to any disclaimer, the term of this patent is extended or adjusted under 35 U.S.C. 154(b) by 309 days.

(21) Appl. No.: 10/913,794

(22) Filed: Aug. 6, 2004

(51) Int. Cl.
*B01F 13/10* (2006.01)

(52) U.S. Cl. ..... 366/145; 366/155.1; 366/181.1; 366/181.5; 222/145.6; 222/146.2

(58) Field of Classification Search ..... 366/14, 366/15, 51, 155.1, 155.2, 181.1, 181.5, 145, 366/148, 149; 222/145.5, 145.6, 146.2; 405/216
See application file for complete search history.

(56) References Cited

U.S. PATENT DOCUMENTS

| | | | | |
|---|---|---|---|---|
| 3,231,245 | A * | 1/1966 | Harvey | 366/28 |
| 3,623,704 | A | 11/1971 | Skobel | |
| 3,708,154 | A | 1/1973 | Middleton | |
| 3,861,155 | A | 1/1975 | Steinberg et al. | |
| 4,019,301 | A | 4/1977 | Fox | |
| 4,221,890 | A | 9/1980 | Dimmick | 525/407 |
| 4,305,672 | A | 12/1981 | Adams | 366/336 |
| 4,439,070 | A | 3/1984 | Dimmick | 405/216 |
| 4,876,896 | A | 10/1989 | Snow et al. | 73/827 |
| 4,892,410 | A | 1/1990 | Snow et al. | 366/2 |
| 4,993,876 | A | 2/1991 | Snow et al. | 405/216 |
| 5,114,239 | A * | 5/1992 | Allen | 366/6 |
| 2006/0007775 | A1* | 1/2006 | Dean | 366/51 |

OTHER PUBLICATIONS

"The Marketplace: Pile Encapsulation and Repair Products," UnderWater Magazine (Article reprint: Summer 1996).

* cited by examiner

*Primary Examiner*—David Sorkin
(74) *Attorney, Agent, or Firm*—Waddey & Patterson, P.C.; Philip F. Walker; Edward D. Lanquist, Jr.

(57) ABSTRACT

A plural component polymer grout plant device for mixing, batching and distributing a multiple component polymer having a filler additive. The polymer grout plant device comprises a frame, at least two primary mixing containers, two batching containers, attached to the frame, a pump assembly operatively attached to the batching containers, and a distribution system operatively attached to the pump assembly. Each batching container includes a floor and distribution opening space from the floor for the removal of the individual components and filler of the polymer. The pump assembly is designed to transport the components and filler of the polymer from the batching containers to the distribution system wherein the distribution system combines the polymer components and distributes the polymer to the desired location.

25 Claims, 8 Drawing Sheets

Shown without Shroud

Shroud detail

PLURAL COMPONENT POLYMER GROUT PLANT

A portion of the disclosure of this patent document contains material that is subject to copyright protection. The copyright owner has no objection to the facsimile reproduction by anyone of the patent document or the patent disclosure, as it appears in the U.S. Patent and Trademark Office patent file or records, but otherwise reserves all copyright rights whatsoever.

All patents and publications described or discussed herein are hereby incorporated by reference in their entirety.

BACKGROUND OF THE INVENTION

The present invention relates generally to a thermostatically controlled mixing, batching and distribution plant for plural component polymer grouts. More particularly, the present invention relates to an improved mixing device for multiple component polymers having granular filler added therein, wherein the device mixes, batches, combines and distributes sufficient amounts of the polymer grout for large placement requirements.

The current improvement to plural component polymer mixing and delivery devices provides novel components of the device to effectively and efficiently mix in large amounts of the individual components of the polymer with the granular filler batch and combine those mixtures into a pre-solidified polymer. These polymers can be inorganic as well as organic. Additionally, the improved device allows for the properly controlled reaction of the components into an applicable polymer prior to complete solidification. Additionally delivering the grout through a recirculating temperature controlled delivery device (water shrouded umbilical) for blending and final placement.

Generally, polymers are long chain molecules formed by numerous interlocking smaller molecules that exist in natural and synthesized states. Epoxy and polyurethane are two forms of synthesized polymers. An epoxy is basically a two component adhesive system composed of a resin and a hardener. The resin and hardener create a chemical reaction and exothermic reaction when mixed together, wherein the chemical reaction produces a binding between the two components and any other material in contact with these two components. Polyurethane is a type of polymer that has two forms of molecular structure and can be crosslinked to form a thermal setting plastic or can remain linear and can remain thermal plastic. The exothermic reaction produced from the reactive components is mass dependant and requires control to assure proper cross linking.

It is known in the art that both epoxies, polyurethanes, polymers, and other multiple component reactive mixtures can be combined with an additive to create and repair support structures. It is also known that several conventional machines have been designed to mix the individual components of the polymer, especially epoxy, with various types of granular filler, or grout. These conventional machines have several drawbacks due to their design and the nature of the polymer grout mixtures.

For example, due to the weight differences between the filler and the components of the polymer, the filler has a tendency to settle to the bottom of any container holding one of the component and the filler prior to the solidification process resulting from the combination of the two components. Additionally, traditionally the exit out of the container that has the component filler mixture in it is located in the bottom of the container. As such, any settling of the filler has a tendency to clog that exit.

Also, traditionally two individual pumps have been used to transfer the individual components to a mixing location. If these pumps are not interconnected and synchronized, inconsistent volumes of the components can be sent to the mixing location. This can result in unwanted mix ratios of the grout mixture that can affect the integrity of the resulting solidified grout.

The conventional mixers also lack the ability to control the temperature and ultimately the viscosity of the individual components. This can lead to inconsistent amounts of the components reaching the blending location, additional clogging within the mixing machines, and other fluid transportation issues. Once again, this can result in unwanted combinations of the polymer mixture that can affect the integrity of the resulting solidified polymer matrix. The inability for conventional equipment to control the exothermic temperature during placement is compromised by its mass dependency and affects the final properties of the grout.

Also, conventional grout plants lack the capacity to quickly and easily replace the various parts of these machines, including the pumping apparatus, which come in contact with the individual components of the polymer. As such any clogging or maintenance issues within those parts become a labor and time intensive task that can reduce the efficiency and effectiveness of those conventional mixing machines usability. Further the relatively small batches and delivery rates limit their large scale placement ability.

What is needed, and is currently lacking in the art, is a plural component polymer grout plant able to properly facilitate the mixing, batching, and combining of a multiple component polymer in large quantities, including the ability to introduce a filler material and wherein the grout plant regulates the temperature/viscosity of the components, reduces clogs within the device, allows for ease of maintenance of the device, and starts the solidification and exothermic process between the multiple components in a controlled environment for enhancement and consistency of final properties prior to placement of the polymer material where desired.

BRIEF SUMMARY OF THE INVENTION

Disclosed herein is a polymer grout plant for mixing, batching and distributing substantial amounts of a multiple component polymer having a filler additive. The polymer grout mixing plant comprises a frame, at least two premixing containers, two secondary batching containers attached to the frame, a plural pump assembly operatively attached to the mixing containers, and a controlled distribution system operatively attached to the pump assembly. Each secondary batching container includes a clean out opening space in the bottom for the removal of the individual unused components for cleaning. The pump assembly is designed to transport the components and filler of the polymer from the mixing containers to the distribution system via a thermostatically controlled umbilical to a location wherein the distribution system combines the polymer components and distributes the grout to the desired location.

The pump assembly further includes multiple cylinders, each cylinder including a pump intake. A conduit is positioned between each distribution opening in the batching container and the pump intake on one of the cylinders. The conduit includes an upward slope from the distribution opening to the pump intake to minimize the dropout problem of filler material that settles during operation of the material intake. One end of each conduit includes a quick release attachment operatively fashioning each pump intake to one of the distribution openings.

The pump assembly is rotatively hinged and attached to the frame. This rotative capability in combination with the quick release connections between the pump intakes and the distribution openings facilitates speedy separation of the pump assembly from the mixing containers to allow cleaning and maintenance of the individual parts of the mixing device.

Each batching container further includes a drain opening positioned on the floor of the mixing container for the removal of the components and filler from the mixing container when the mixing device is to be cleaned. Additionally each mixing container is positioned substantially horizontally adjacent to the other mixing container.

The distribution delivery umbilical system further includes a static mixer operatively positioned after the pump assembly to combine the components of the polymer. Additionally, the distribution system includes a distribution and isolation guide operatively positioned after the static mixer to supply the combined polymer to the desired location. The static mixer combines the two components and the umbilical distribution guide allows the user of the polymer grout mixing device to selectively place the polymer grout as desired. The guide/isolation device is of sufficient length and flexibility to facilitate the dampening of wave action and currents allowing the use of injection ports attached to thin wall FRP jackets routinely used in the industry. This guide is designed as neutrally buoyant, and can be attached to a strain relief at the down stream placement location. The pump assembly further includes a recirculation manifold positioned to selectively return the components to the batching containers from the pump assembly. This manifold allows a user of the grout plant to selectively recirculate a portion of the components in the pump assembly back to the batching container for fine delivery ratio adjustment. Additionally, an air motor is operatively attached to the pump assembly in order to operate the pleural pump assembly. This air motor is operatively attached to an air purifier positioned to remove impurities and moisture from the air used by the pump assembly thereby eliminating air motor valve failure due to icing.

Each premixing container and batching container further includes a mixing element positioned within the container to mix one of the components and the filler while maintaining a negligible amount of aeration in the mixture of the one component and the filler.

Additionally, a temperature control system operatively engages each mixing container and the delivery umbilical to maintain the components in each mixing container and umbilical at a predetermined temperature. The temperature control system includes a fluid filled chamber substantially surrounding each mixing container and umbilical and a thermostatically controlled heating element regulating the recirculating fluid temperature.

The pleural component polymer grout plant further includes at least two preliminary mixing bins attached to the frame and positioned to transfer a mixture of one of the components and filler to one of the batching containers. These preliminary mixing bins are positioned to transfer the mixture of one of the components and filler directly into the batching container by a simple rotation, siphoning, draining, or other techniques known in the art.

It is therefore an object of the present invention to provide a polymer grout mixing/plant device.

Another object of the present invention is to provide a polymer grout plant device having a temperature control system used to maintain the temperature and viscosity of the components of the polymer.

Yet another object of the present invention is to provide a mixing device used to individually mix a component of polymer with filler while maintaining a minimal amount of aeration in the component.

Still yet another object of the present invention is to provide a mixing device designed to reduce clogging within the device.

And yet still another object of the present invention is to provide a mixing device having an improved pump allowing the mixing device to operate at high pressures and volumes.

Another object of the present invention is to provide a pump assembly that is easily disassembled in order to facilitate maintenance and repairs to various aspects of the mixing device.

Still yet another object of the present invention is to provide a plural polymer grout plant device having a distribution system that facilitates the initiation of solidification of a multiple component polymer grout in a substantially controlled environment. Another object of the present invention is the ability to mix, batch, and place large amounts of material using at least four mixing containers holding 6 cubic feet of material each.

Other and further objects features and advantages of the present invention will be readily apparent to those skilled in the art upon reading of the following disclosure when taken in conjunction with the accompanying drawings.

DETAILED DESCRIPTION OF THE INVENTION

Figure 1:
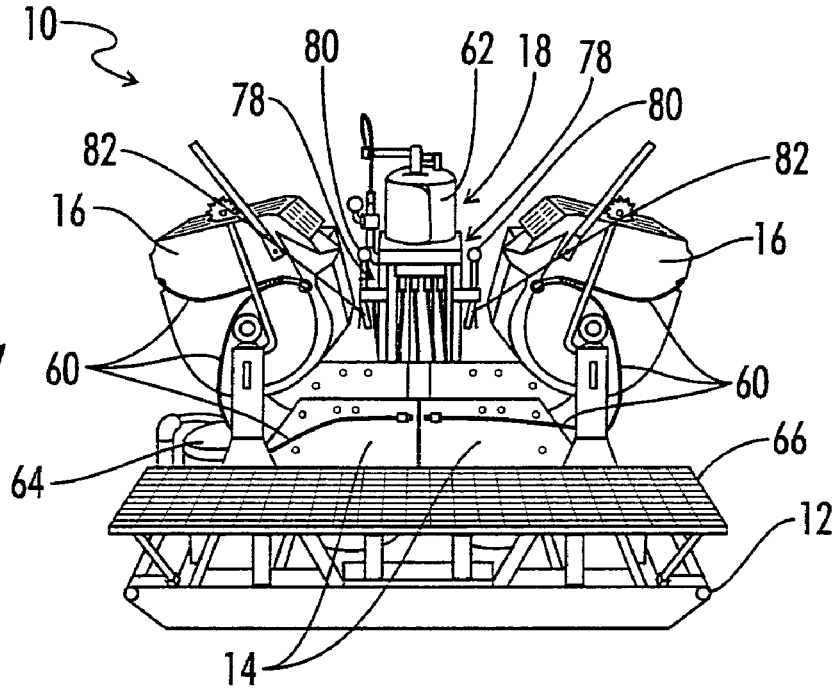
FIG. 1 is a front perspective view of the plural component polymer grout plant device made in accordance with the current invention.
Figure 2:
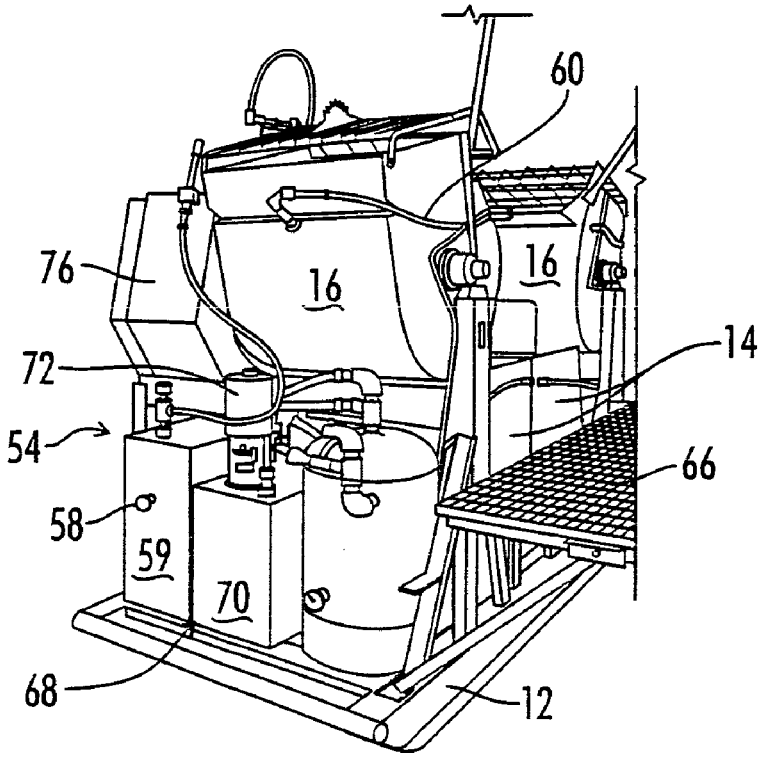
FIG. 2 is a side perspective view of the plant device shown in FIG. 1.
Figure 3:
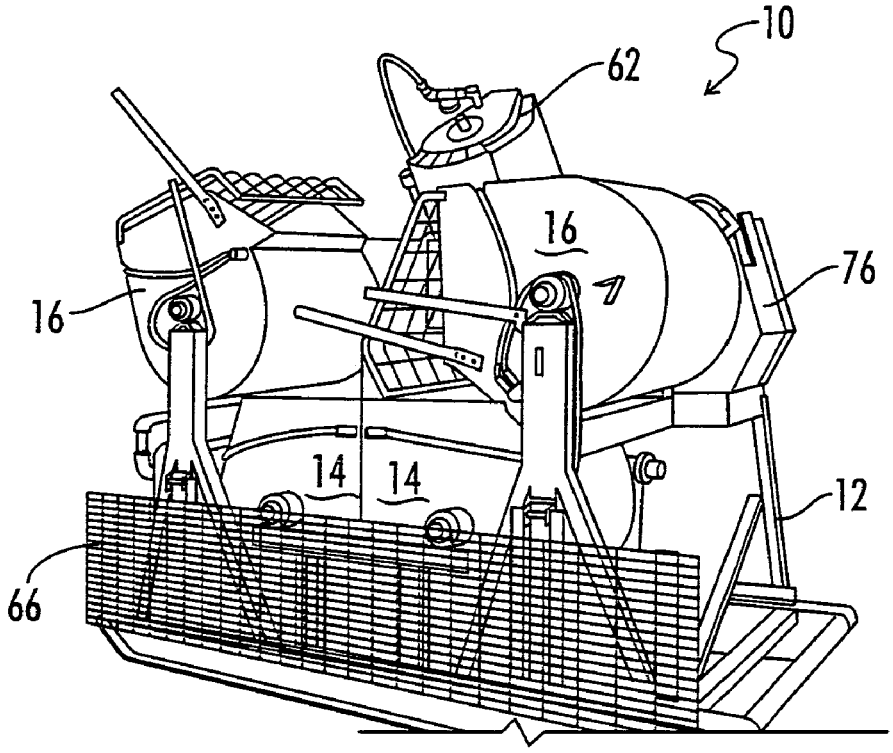
FIG. 3 is a front perspective view of the plant device shown in FIGS. 1–2.
Figure 4:
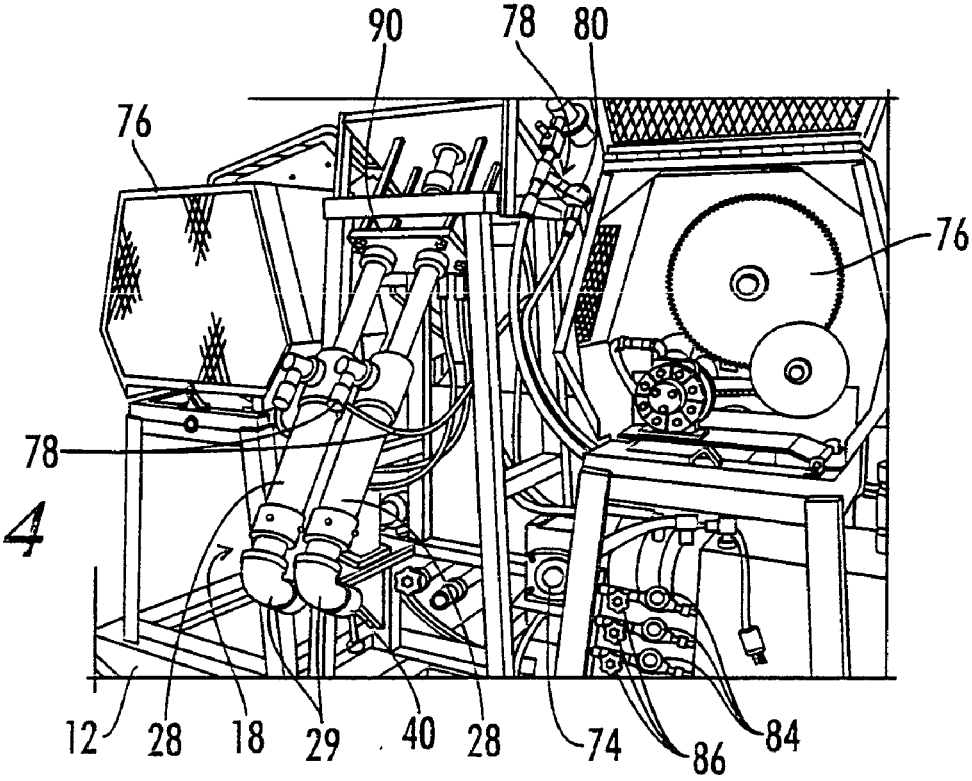
FIG. 4 is a partial back perspective view of the plant device shown in FIGS. 1–3.

Referring generally to FIGS. 1–16, a polymer grout plant is generally shown and designated by the numeral 10. The plant device (10) is for mixing, batching, and distributing a multiple component polymer having a filler additive as known in the industry. The mixing filler can be items such as sand, rock, aggregate clay, ground shale, mill glass fiber, cinder slag, or like granular solid materials. The grout plant device (10) is preferably designed to be a complete plural compound polymer grout batching and placement system. The grout plant (10) is designed to incorporate the ability to mix batches of polymer and granular aggregate, which is used as an extender. The grout plant device (10) is designed to process these components and to allow for accurate metering, dispensing, and subsequent placement of the polymer grout to a desired location by the user of the grout plant device (10).

The grout plant (10) comprises a frame (12), at least two premixing containers and two batching containers (14) attached to the frame (12). A pump assembly (18) operatively attached to the batching containers (14), and a distribution system (20) operatively attached to the pump assembly (18). Each mixing container (14) includes a bottom cleanout (22) and a distribution opening (24) elevated from the floor (22) for removal of the individual components and filler of the polymer. Additionally, each mixing container (14) includes a drain opening (26) positioned on the floor (22) for the removal of the components and filler from the mixing container (14). Additionally, the mixing containers (14) are positioned substantially horizontally adjacent to one another.

The pump assembly (18) is operatively attached to the mixing containers (14) to transport the components and filler of the polymer from the mixing containers (14). The pump assembly (18) further includes multiple cylinders (28) wherein each cylinder (28) includes a pump intake (30). Additionally, each cylinder (28) includes thick reinforced cylinder walls (32) positioned to allow the operation of each cylinder (28) at a high pressure and volume. Preferably this pressure can be greater than 1200 pounds per square inch. Additionally, each cylinder (28) includes a sealing system (34) that includes multiple separate seals (35, 36, and 37) positioned within the cylinder (28) to allow operation of each cylinder at a high pressure. A conduit (38) is further positioned between each distribution opening (24) and each pump intake (30). The conduit (38) includes an upward slope from the distribution opening (24) to the pump intake (30). The slope of the conduit (38) allows the filler material mixed with the components of the polymer to return to the batching containers (14) as the filler particles settle. For example, as the components and filler travel along the conduit (38) and into the pump assembly (18) any separation of the filler material from the components can return to the batching containers (14). Preferably the angle of the slope of the conduit (38) ranges from 15 degrees to 60 degrees. Most preferably the angle of the conduit (38) is 45 degrees.

The conduit (38) can also be described as an incline feed system from the mixing containers (14) to the pump assembly intake (18). This incline feed system causes the components and filler to flow upward prior to introduction into the lower portion of the cylinders (28). This upward flow allows any materials from that mixture that have settled, such as the heavy particulates that comprise the filler, to migrate away from the pump intake (30) and back to the distribution opening (24) and the batching containers (14). This return to the mixing containers (14) minimizes typical clogging problems in conventional systems such as the problems caused from filler dropout. Alternatively, the conduit (38) can have an inclined plane positioned within the conduit (38) to provide for the proper inclined slope.

Figure 5:
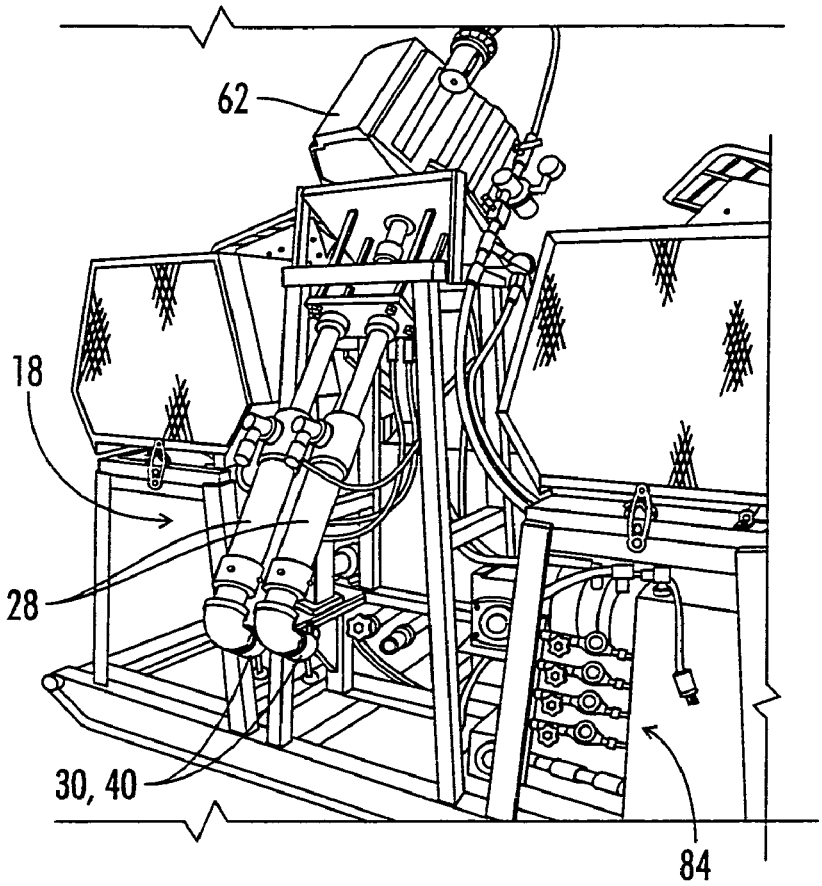
FIG. 5 is a partial back perspective view similar to FIG. 4.
Figure 6:
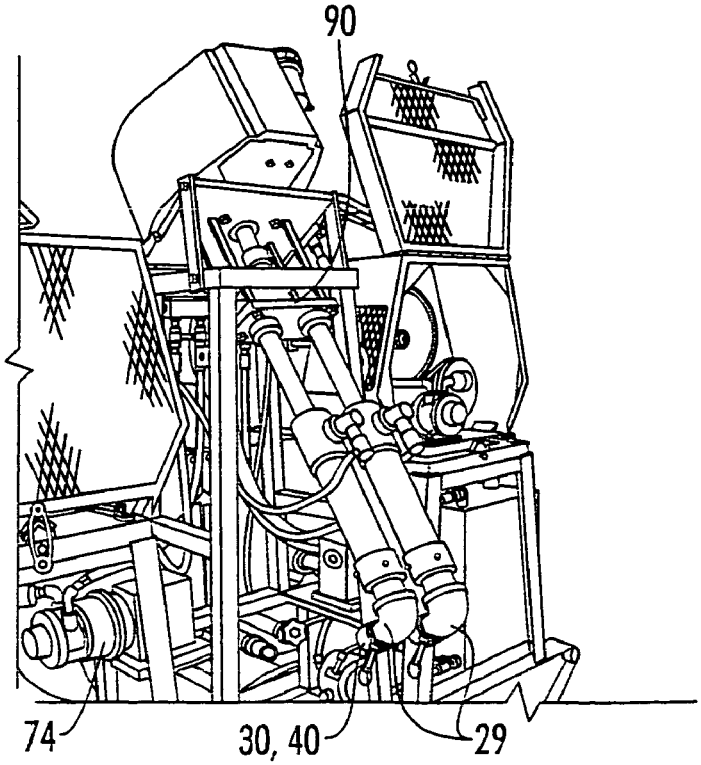
FIG. 6 is a partial back perspective view of the plant device shown in FIGS. 1–5.
Figure 7:
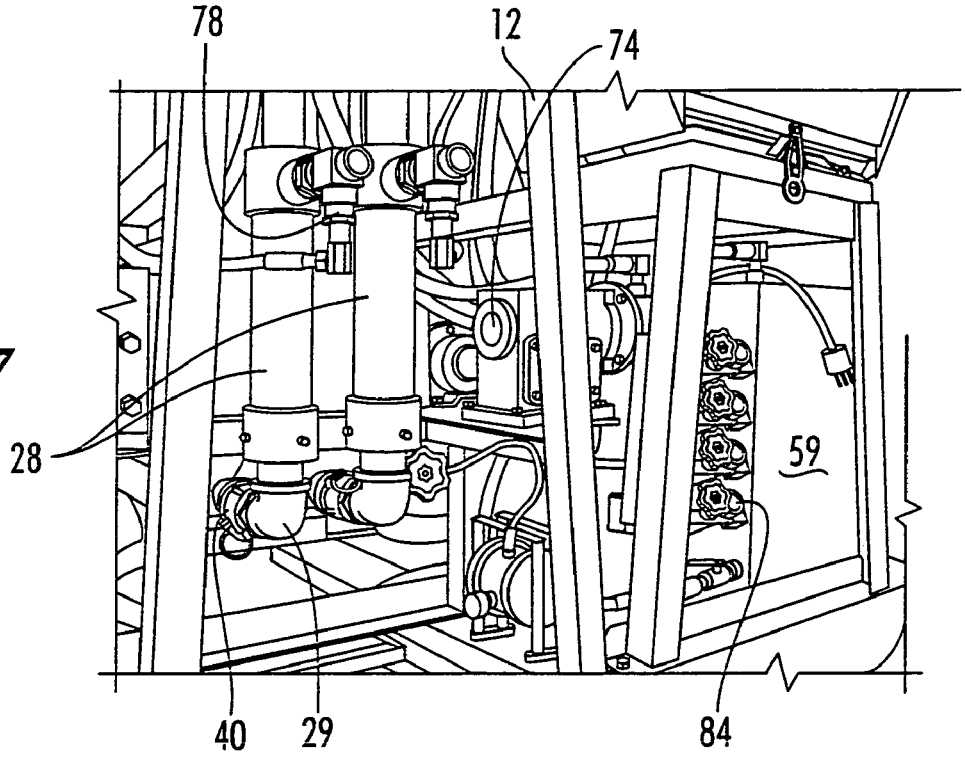
FIG. 7 is a partial back perspective view of the grout plant device showing in greater detail the cylinders of the pump assembly.
Figure 8:
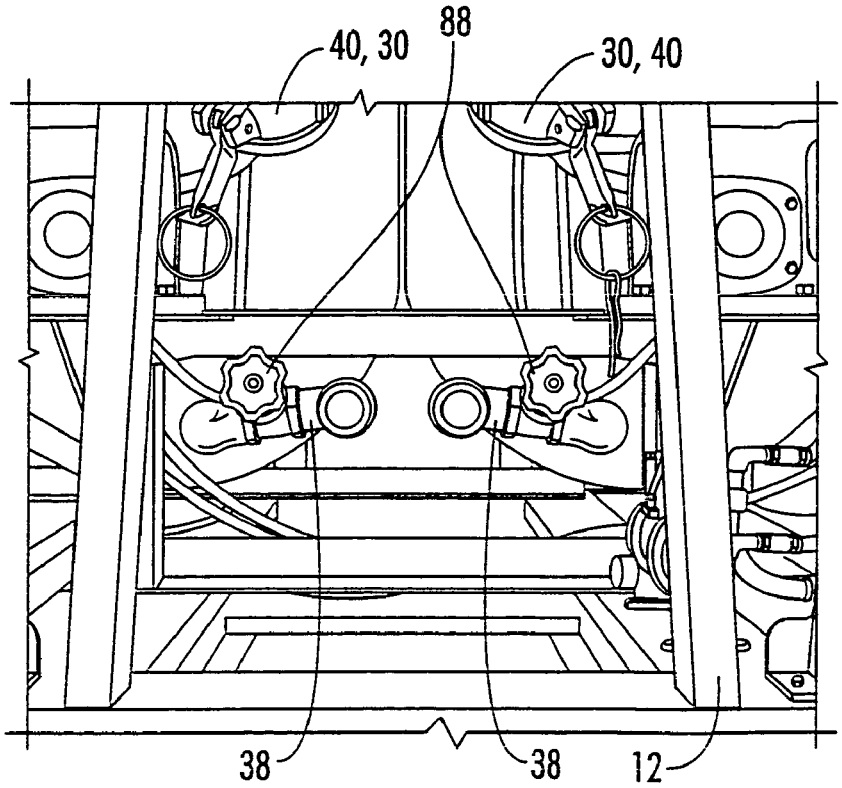
FIG. 8 is a back detail view of an embodiment of the conduits made in accordance with the current invention.
Figure 9:
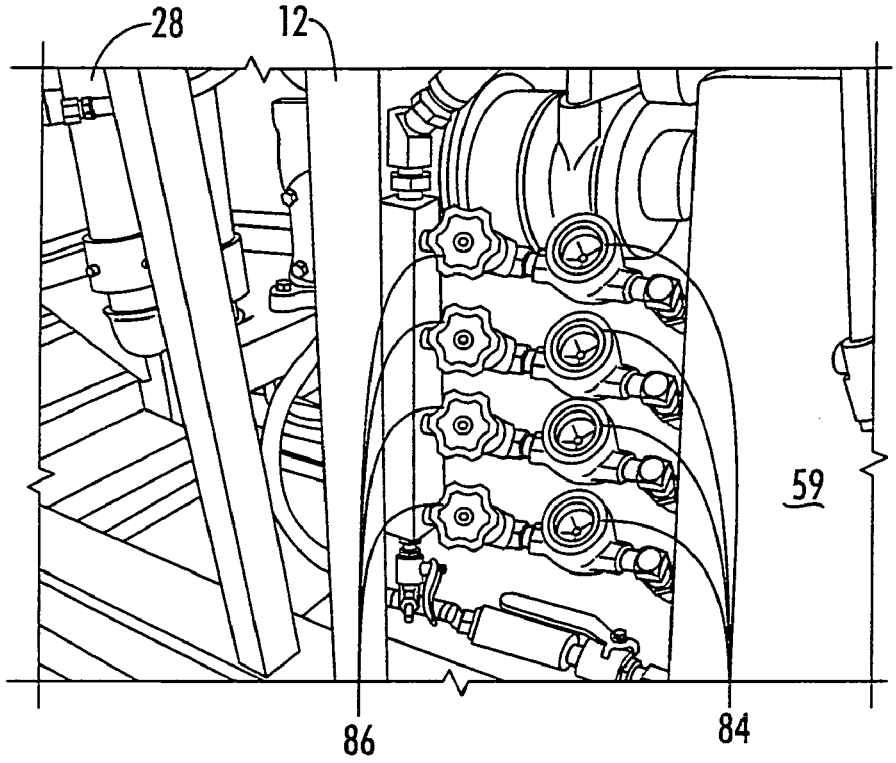
FIG. 9 is a back partial perspective view showing detail of various flow meters used on the grout plant device made in accordance with the current invention.
Figure 10:
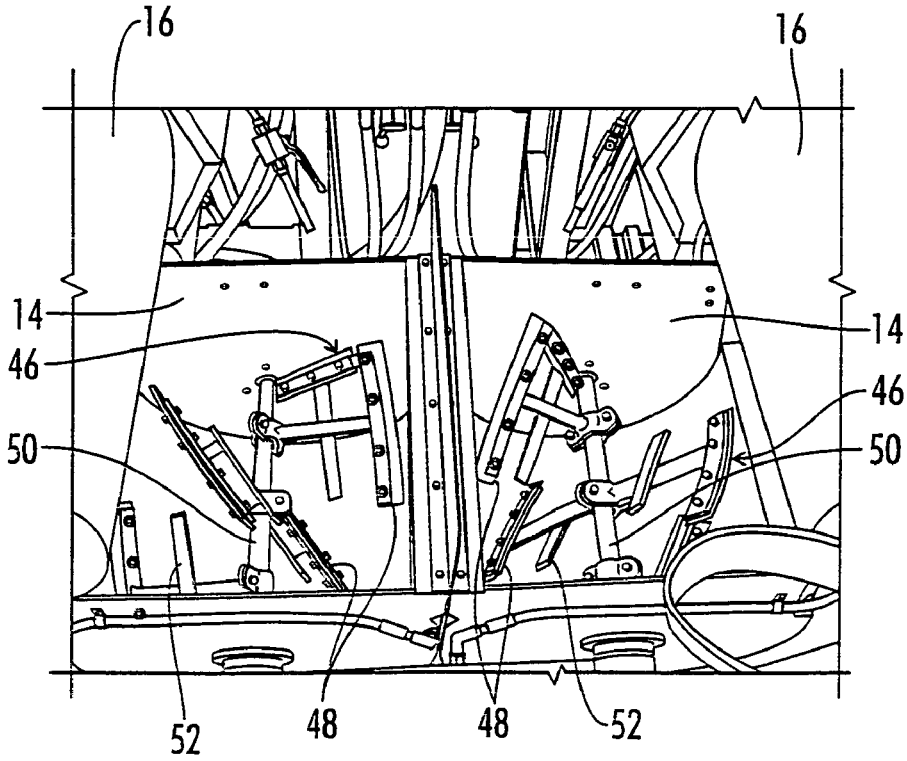
FIG. 10 is a top view showing the mixing elements within the mixing containers used in the grout plant device.
Figure 11:
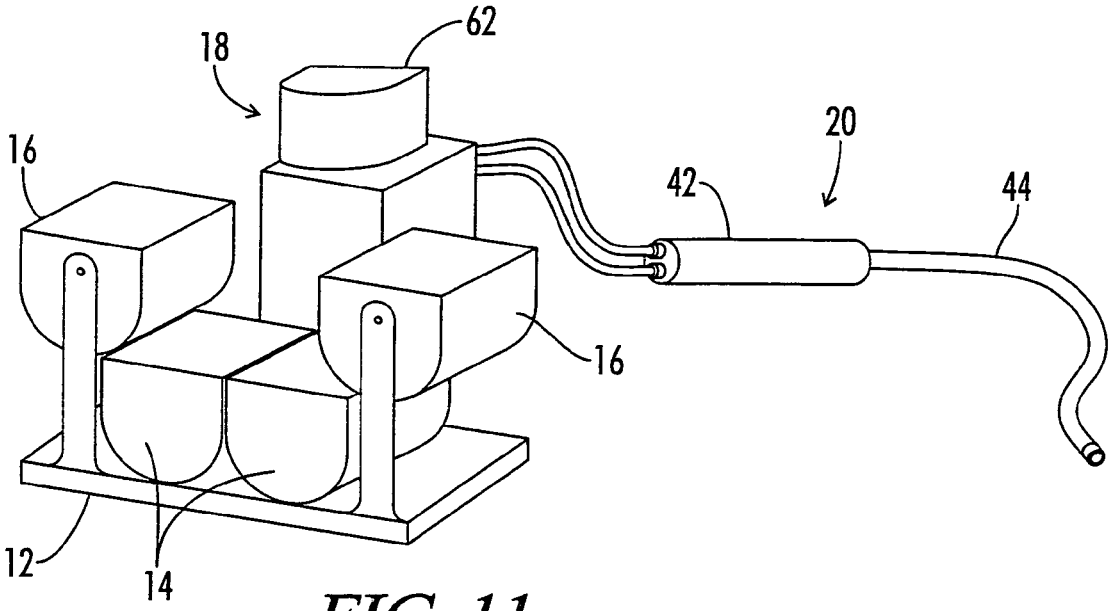
FIG. 11 is a schematic view showing an embodiment of a grout plant made in accordance with the current invention.
Figure 13:
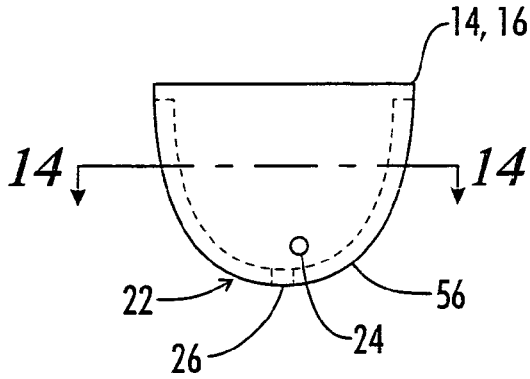
FIG. 13 shows a schematic end view of an embodiment of the mixing container made in accordance with the current invention.
Figure 12:
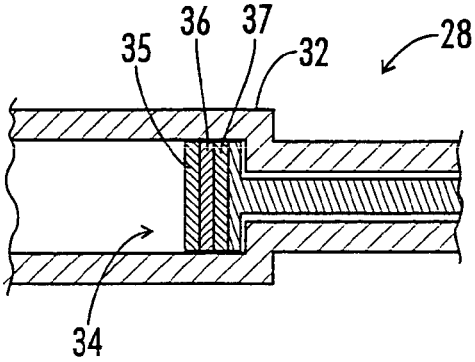
FIG. 12 shows a partial cross sectional schematic view of one embodiment of a cylinder used in a pump assembly made in accordance with the current invention.
Figure 14:
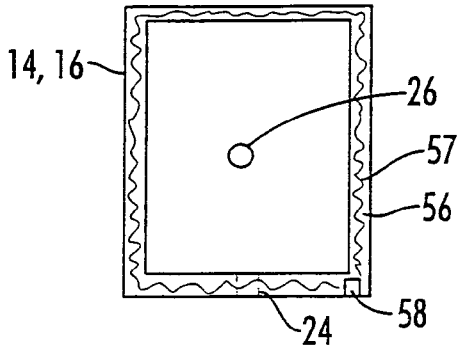
FIG. 14 shows a cross sectional view made along line 14—14 of FIG. 13.
Figure 15:
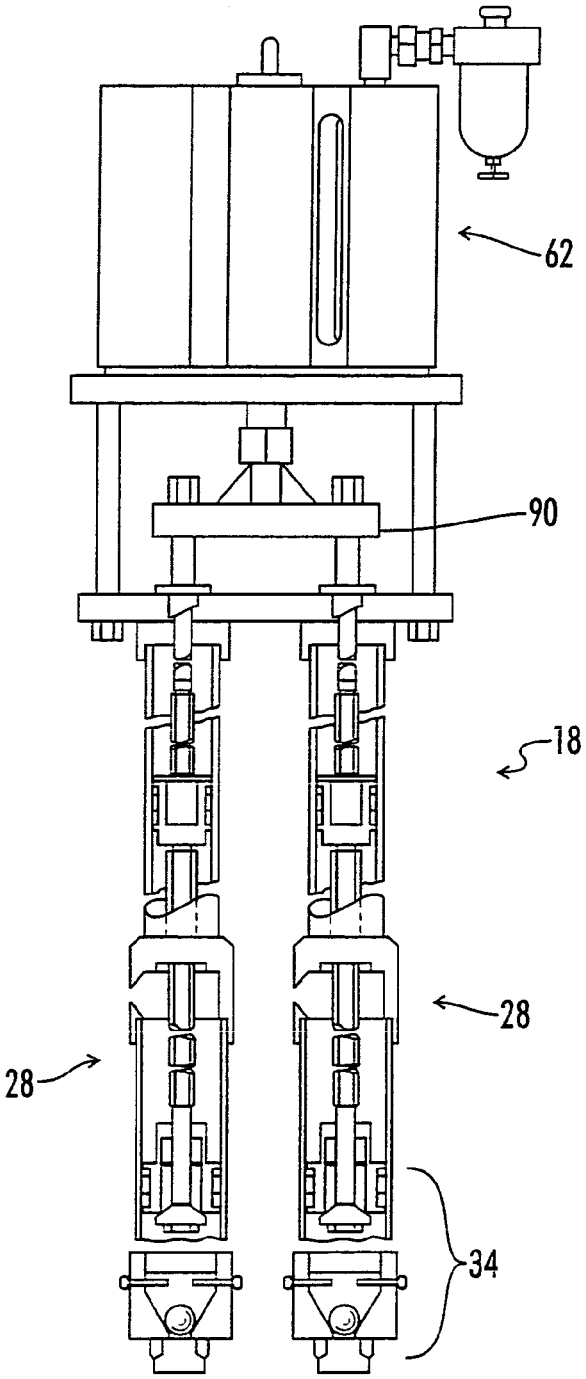
FIG. 15 is a partial view of one embodiment of an air motor and cross sectional view of an embodiment of cylinders used in a mixing device made in accordance with the current invention.
Figure 16:
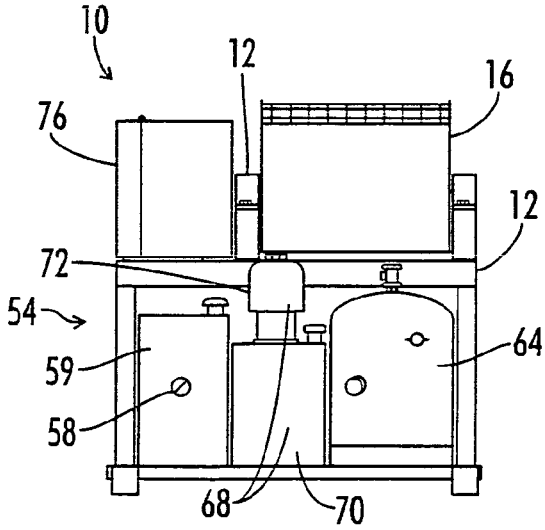
FIG. 16 is a schematic end view of a grout plant device showing the air purifier, solvent flush tank, and temperature control tank.

Additionally the pump assembly (18) includes a quick release attachment (40) operatively fastening each pump intake (30) to one of the distribution openings (24). Preferably the quick release attachment is positioned at each end of the cylinder (28) that connects to the conduit (38). This quick release attachment (40) allows separation of the pump assembly (18) from the mixing containers (14) and conduit (38). Additionally, as best seen in FIG. 5, the pump assembly (18) is rotatively attached to the frame (12).

The use of the quick release attachment (40) in conjunction with the rotateable attachment of the pump assembly (18) to the frame (12) facilitates quick separation of the pump assembly (18) from the remainder of the mixing device (10). This quick separation facilitates the ease of maintenance, repairs, and cleaning of the pump assembly (18) and various other parts of the mixing device (10).

The distribution system (20) is operatively attached to the grout plant assembly (18) for combining the polymer components and distributing the polymer. The distribution system includes a thermostatically controlled recirculating shrouded umbilical, static mixer (42) operationally positioned after the pump assembly (18) and a motion dampened distribution guide (44) operationally positioned after the static mixer (42).

The static mixer (42) can be any mixer known in the art to statically mix two components. In a preferred embodiment, the static mixer is a length of tubing containing a ribbon mixer within the tubing. Additionally, multiple static mixtures (42) can be combined in series.

The distribution guide (44) can be any guide known in the industry to direct fluids. However, in a preferred embodiment, the distribution guide is insulated, fluidly temperature controlled, and is of sufficient length to control the initial solidification of the two components into a polymer matrix.

In this embodiment, the distribution guide (44) can also be described as a stinger (44) and is preferably at least 20 feet long. The stinger (44) can be fitted with a pigging device to remove the mixed components after an application of the mixing device (10) has been completed. Alternatively, the stinger (44) can be discarded after operation of the mixing device has been suspended for a prolonged period of time. The determination of when the stinger (44) needs to be discarded or the pigging device needs to be operated depends on the appropriate reactivity for the specified components of the polymer, ambient temperature, and application location. Due to a broad range of reactivities available between components, this time could be as short as a few minutes or as long as a significant portion of a day.

Each mixing container (14) further includes a mixing element (46) positioned within the mixing container (14) to mix one of the components and the filler within the mixing container (14). A mixing element (46) is also designed to maintain a negligible amount of aeration in the mixture of the one component and the filler. Alternately stated, the mixing element (46) is designed to keep from introducing a significant amount of air into the mixture of the component and the filler as a mixing element (46) mixes the component and the filler. The mixing element (46) includes armatures (48) attached to a rotatable shaft (50). Each armature (48) preferably includes cross pieces (52) designed to increase the mixing capacity and thoroughness of the mixing element (46).

Additionally, the mixing device (10) includes a temperature control system (54) operatively engaging each mixing container (14) to maintain the components in each mixing container at a predetermined temperature. The temperature control system (54) can also be described as a viscosity control system (54) wherein the viscosity control system (54) maintains the viscosity of the components in each mixing container (14).

The temperature control system (54) includes a fluid filled cavity (56) which can also be described as a fluid filled chamber (56), substantially surrounding each mixing container and delivery umbilical (14). The temperature control system (54) also includes a thermostatically controlled heating element (58) positioned to regulate the fluid temperature within the fluid filled cavity (56). The fluid (57) used in the fluid filled cavity (56) can be stored within the fluid filled cavity (56) or can be stored in a fluid tank (59). The thermostatically controlled heating element (58) can be positioned to regulate the temperature of the fluid (57) in the fluid tank (59). Alternatively, the thermostatically controlled heating element (58) can be positioned within each fluid filled cavity (56) to heat the fluid (57) located therein. There are various hoses (60) connecting the fluid tank (59) to the fluid filled cavities (56) of the various mixing containers (14) which allows a transfer of the fluid (57) between the fluid tank (59) and the fluid filled cavities (56).

Also included is an air motor (62) operatively attached to the pump assembly (18) to operate the pump assembly (18). The air motor (62) operates the cylinders (28) of the pump assembly (18) in order to transport the components and filler of the polymer. Additionally, an air purifier (64) is operatively attached to the air motor (62) to remove impurities and moisture from the air used by the pump assembly (18).

Included are at least two preliminary mixing bins (16) which can also be described as two preliminary mixing containers (16). The preliminary mixing containers (16) are attached to the frame (12) and positioned to transfer a mixture of one of the components and the filler to one of the batching containers (14).

The grout plant (10) further includes a platform (66) positioned where an operator of the grout plant(10) can place the components and filler comprising the polymer grout in the mixing preliminary mixing containers (16). The platform (66) is rotateably attached to the frame (12) and can be folded in a vertical position to facilitate storage and movement of the grout plant (10).

The grout plant (10) also includes a solvent system (68) having a solvent tank (70) and a flush pump (72). The solvent system (68) is operatively attached to the grout plant assembly (18) and the various hoses and passageways of the mixing device (10) that contacts the components of the polymer, especially the pump assembly (18). The solvent system (68) can clean those hoses and passageways during maintenance of the grout plant(10).

The batching containers (14) and the preliminary mixing containers (16) include motors (74) operatively attached to the batching containers (14) and preliminary mixing containers (16) to operate the mixing elements (46) in order to mix the individual components and filler of the polymer grout. The motors speed is adjustable and (74) are a operatively attached to a gearing system (76) positioned to provide a desired torque and turning velocity to the mixing element (46).

The batching containers (14) and the preliminary mixing containers (16) can also be described as have a double wall construction positioned to establish the fluid cavity (56) for the addition of the fluid (57).

The mixing elements (46) can also be described as paddle mixers (46) that homogenize the fillers, which or can be described as extending materials, into the separate components of the polymer. Preferably these mixing elements (46) are located in both the batching containers (14) and the preliminary mixing container (16).

The preliminary mixing containers (16) are rotatively attached to the frame (12) in order to allow the preliminary mixing containers (16) to rotate and transfer the homogenized mixture of the filler and one of the components of the polymer to the batching containers (14).

The specially designed reinforced cylinder walls (32) of the cylinder (28) preferably consist of stainless steel. These walls (32), in combination with the multiple sealing system (34), allow for a longer duty cycle of pumping and a longer life of the sealing system (34) and cylinders (28). These designs also allow for high operating pressures, volumes and increased flow rates of the components and filler.

For example, using the specially designed cylinders (28), including the wall (32) and sealing system (34), the mixing device (10) is capable of operating normally at a pressure of approximately 1,800 pounds per square inch. Conventional mixing devices typically have a working pressure of only 800 pounds per square inch. Due to this increased operating pressure, the mixing device (10) can handle larger volumes of material having high viscosities. This increases the ultimate distribution of the polymer grout and increases the overall lifespan of the mixing device.

Preferably the motors (74 and 62), are air operated motors that operate the mixing, batching, and pumping of the grout plant (10). These motors control the mixing and agitation of the components with the mixing arms (46) and the operation of the pump assembly (18) to transport the components.

The mixing device (10) can handle mismatched viscosities and volumes of the components while maintaining predetermined mixed ratios between the components. This can be accomplished by varying the size of the cylinders (28) and use of the return manifold (78). The return manifold (78) is positioned to selectively return the components from the pump assembly (18) to the batching containers (14). This selective recirculating of the components allows the balancing of the output of the pump assembly (18) prior to the delivery of the components to the distribution system (20).

The return manifold includes gauges (80) positioned to read the pressure within the pump assembly (18), especially at the exit side of the cylinders (28) prior to the components reaching the distribution system (20). Additionally, valves (82) can be user operated and activated to allow an amount of the components to be siphoned from the exit side of each cylinder (28) and returned to the batching containers (14). The user can activate the controls (82) to regulate the pressure and verify that pressure on the gauges (80) until the components return to the predetermined ratio specified for that particular application of the polymer.

The temperature control system (54) can be described as a close loop hot water system (54) using a water glycol tank (59) that includes a thermostatically controlled heater (58) and a recirculation pump (not visible). The fluid (57) can be circulated through the delivery umbilical both the batching containers (14) and the preliminary mixing containers (16), specifically the fluid can be circulated through the cavities (56) that have resulted from the shrouded umbilical, double wall construction of the batching containers (14) and preliminary mixing containers (16).

Between each batching container (14) and preliminary mixing container (16) and the fluid tank (59) is a flow control indicator (84) and valve (86) used to adjust the flow and temperature of the fluid (57) as the fluid circulates between the delivery umbilical, fluid tank (59) and the cavities (56). This circulation allows the grout plant (10) the ability to process and distribute polymers in very low ambient temperatures while maintaining the components at the proper temperature and viscosity for proper flow control and placement.

The distribution system (20) further includes a discharge umbilical (44) that is used for delivery and placement of the polymer grout. The discharge umbilical (44) includes temperature control features and contains two separate hoses inside of a shrouded water jacket. At the upstream side, this umbilical incorporates a water jacket inlet where hot water is introduced and flows to the downstream end of the shrouded jacket. The discharge end of the jacket has a valve and return hose to allow a controlled release of hot water back to the reservoir. The volume is regulated by this valve arrangement. This control of the temperature of the components and epoxy in the umbilical (44) helps facilitate use of the grout plant (10) in low temperature applications and increases the environmental conditions in which the grout plant (10) can be operated.

The air purifier (64) can be described as integrated air scrubbers (64). This integrated air scrubber (64) is used to remove moisture and impurities from the air used by the mixing device (10) and allows for the introduction of lubricants in order to increase the service life of the air motors (64 and 74). The air purifier (64) is preferably used to reduce the moisture content in the air used by the air motors (64 and 74) in order to keep the motors from freezing or icing up.

Preferably, the various gauges (80) are used to substantially maintain consistency in the volume and viscosities of the components transported through the mixing device (10). These gauges (80) preferably include stainless steel isolators which keep the component material separated from the input orifices of the gauges (80) to facilitate continued operation without clogging the gauges. This is especially true in order to protect the soft parts and working components of the pump assembly (18) and the gauges (80). The isolators can be described as piston controlled elements that transfer pressure from the components to a fluid filled cavity in which the gauge reads the pressure in that fluid filled cavity.

In the preferred embodiment, the quick release attachment (40) is a cam lock attachment (40) used to quickly disconnect the pump assembly (18) from the mixing container (14). This quick release attachment (40) combined with the rotatatively attached pump assembly (18) facilitates maintenance and shortens the maintenance delay time for the pump assembly (18) and the various items attached thereto. Additionally, gate valves (88) can be used to stop the flow of components between the batching containers (14) and a pump assembly (18).

The various portions of the grout plant (10) can be color coordinated in order to allow a user of the grout plant (10) to maintain consistency in which side of the mixing device (10) is used in connection with a specific component of the polymer or consistence in which side of the grout plant (10) a particular component of the polymer is placed. For example various hoses, attachments and fittings can be specifically color coded to visually correlate one of the sides of the mixing device (10) to one of the specific components of the polymer. This is designed to eliminate the accidental cross-contamination of the components (10) by a user of the grout plant (10).

Additionally, the individual components between the distribution system (20), pump assembly (18), and mixing containers (14) can have special fittings on each side of the mixing device (10) such that like components on one side of the mixing device (10) will not connect to the other side of the mixing device (10). The various connections can use a combination of male and female couplings to restrict cross contamination. For example, one distribution opening (24) can have a male coupling while the conduit (38) associated with that distribution opening (24) will have a female coupling. Conversely, the other distribution opening (24) will have a female coupling while the conduit (38) associated with that distribution opening (24) will have a male coupling. As such, each side of the grout plant (10) will have parts that only attach to the corresponding parts for that side of the mixing device (10).

In a preferred embodiment the cylinders (28) are constructed of high pressure carbon steel fittings and stainless steel cylinder walls, piston assemblies, and connecting rods. The cylinders (28) operate to displace the materials in both an up and down stroke as powered by the air motor (62). This movement is facilitated through the use of a check ball in the lower portion of the cylinder (28) and the utilization of a cone nut on the piston attaching rod. Cup seals are preferably used as the seals (35–37) and are made of various materials corresponding to the specific reactive components used in the creation of the polymer. The seals can be provided in leather, rubber, Teflon, or other materials used to resist the chemical reactions to the components of the polymers.

Additionally, due to the nature of the moving granular filled enriched material, abrasive action can erode the surfaces of both the seals and the cylinders. However, due to the rotatable attachment and quick disassembly features of the mixing device (10), both of these high wear items can be easily replaced by the operator. Additionally, the stainless heavy duty thick cylinders (28) are threaded into carbon steel intake elbows (29) that can be easily removed and serviced or changed as required.

Preferably the pump assembly (18) includes a yoke positioned between the air motors (62) and the cylinders (28). The yoke (90) is especially designed to interrelate the output of the air motor (62) to two cylinders (28).

At the end of a usable cycle in which the mixing device (10) is used, the pump assembly (18) can be cleaned using the solvent system (68). Specifically, the flush pumps (72) can circulate solvent from the solvent tanks (70) through the pump assembly (18). The solvent can then be recirculated and captured for reuse numerous times during the solvent's useful life.

Preferably the various hoses used to facilitate the transfer of different polymer materials material at high pressures are typically nylon, wire, braided to withstand 2,200 pounds per square inch. Other types of non reactive hoses can be used as well.

Method of Operation

The grout plant (10) can be operated in the following manner. The components of the polymers are supplied to the preliminary mixing containers (16) wherein the mixing elements (46) are activated to blend the material. Next the filler is added to the preliminary mixing container (16) as desired. After these individual materials are thoroughly mixed, the preliminary mixing containers can be rotated to transfer the homogenized material to the batching containers (14). The mixing elements (46) in the mixing and batching containers (14) are activated in order to continuously mix the now blended plural components. If need be, a second batch of material can be readied in the preliminary mixing containers as needed for the specific volume application required in which the grout batch (10) is needed. The mixing elements in the batching containers (14) preferably turn at slower speed than the mixing elements in the preliminary mixing containers (14). As such aeration and cavation are greatly reduced in the batching containers (14).

A control valve can be operated that introduces a regulated air pressure into the pump air motor (62). The air motor activates the cylinders (28) of the pump assembly (18) to begin transferring the individual components into the pump assembly (18). The activation of the cylinders (28) draws the components through the conduits (38) and the cylinders (28) and transfers the materials to the distribution system. Specifically materials are transferred to the static mixer (42) and on to the distribution guide (44). The static mixer (42) combines the individual components of the polymers and begins the solidification process. The distribution guide (44) allow selective placement of the polymers while controlling the initial solidification as the epoxy travels over the length of the distribution guide to the required placement location (44).

If ambient temperature changes cause the viscosities to increase or flow delivery amounts decrease the temperature control system (50, 54) can be adjusted to maintain the required viscosity/flow ability within the components. Alternatively, the return manifolds (78) can be adjusted to compensate a ratio balance and return a portion of one or both of the components back to their original mixing containers (14). Additionally, the unification of both cylinders (28) powered by a single air motor (62) reduces the likelihood of an unequal balancing of the components.

Delivery/Umbilical

Figure 17:
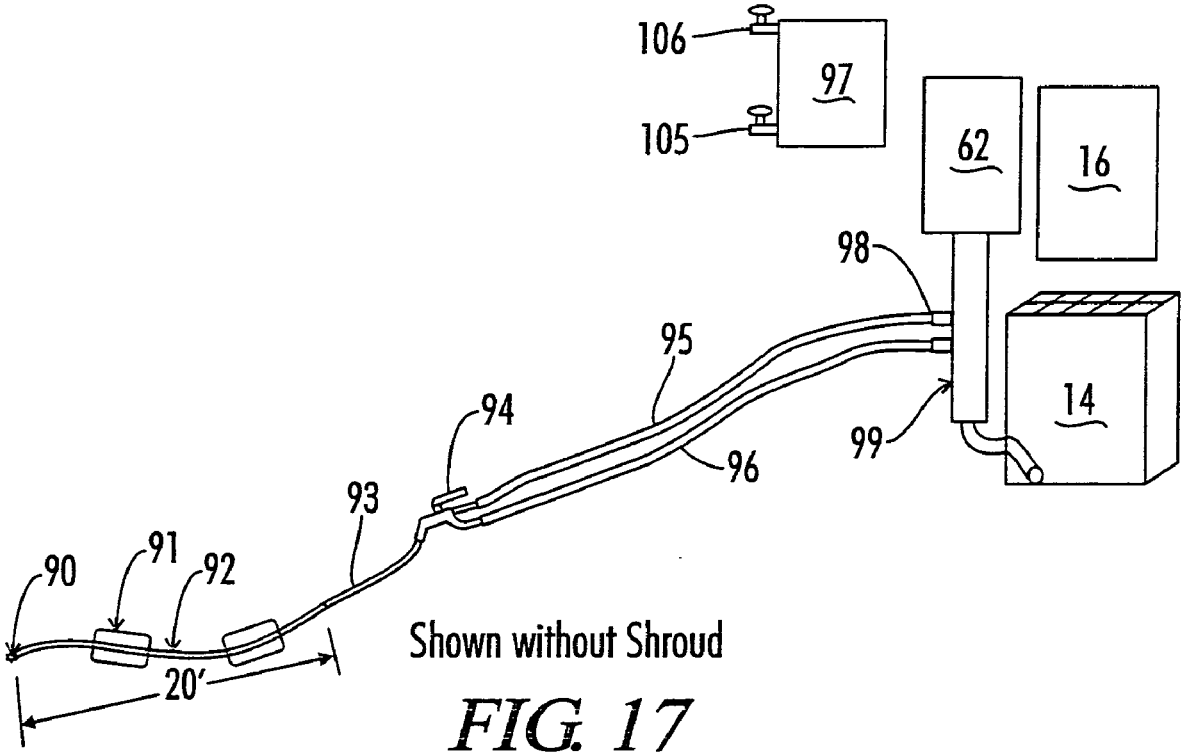
FIG. 17 is a hose schematic.
Figure 18:
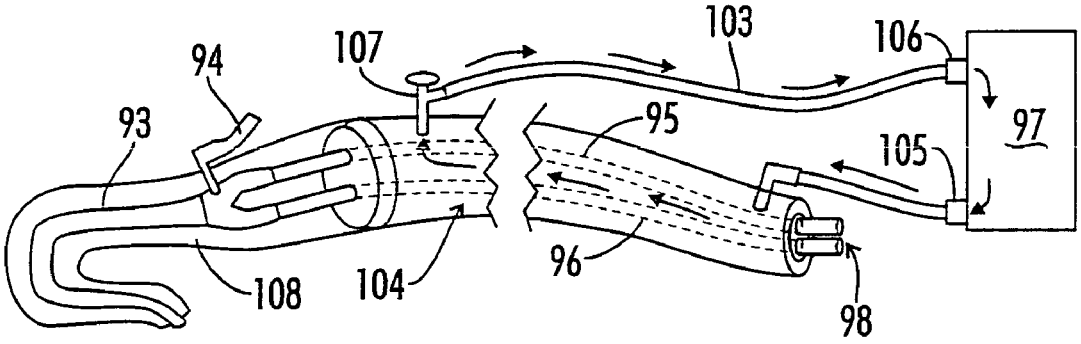
FIG. 18 is a view of the shroud.

A thermostatically controlled delivery system is described. As shown in FIGS. 17 and 18, when polymer grout leave the pump (99) it enters the umbilical assembly through quick disconnect fittings (98) the grout travels via the conduit (95,96) to a distance required for placement. The plural component grout enters a valve assembly (94) which controls the material flow entering the static mixer (93). The static mixer combines the plural component products and starts the chemical reactive process. As the polymer grout material begins its chemical reaction, it enters the disposable stinger (92). This twenty foot stinger allows for among other things the ability for the reactive components to exotherm in a controlled environment which is not effected by mass/temperature dependency. Further, this stinger (92) is designed to be neutrally buoyant by addition of flotation (91). This neutral buoyancy assist in dampening the effects of wave and tidal movement assisting placement in the marine environment using thin FRP jackets as commonly used in the industry. The catalyzed material is placed where required as it leaves the end of the stinger through a quick disconnect (90). In order to facilitate controlling the temperature/viscosity of the polymer grout a shroud is used (104) which contains a heated liquid which is supplied from the recirculating pump of the grout plant. The thermostatically controlled water leaves the holding tank (97) from the bottom (105) and is introduced into the upper end of the shroud assembly (104). Downstream the heated water passes through a control valve (107) and travels back to the recirculation tank (97) through the return hose (103) and enters the circulating tank top (106). Flow direction of hot water is explained as departing recirculation tank (97) through its discharge (105) into the shroud (104). The shroud encapsulates the plural component hoses (95,96) both ends of the shroud (104) are sealed so that the heated water entering from (105) is diverted through the discharge valve of the shroud (104) through the valve (107), through the return hose (103) and reenters the tank top (106). Additional shrouding (108) can be utilized for extreme cold water/surface temperatures. This additional shroud can encapsulate the grout control (94) and the static mixer (93) as well as the stinger (92) Temperature is regulated at the reservoir (97) and flow control/volume is regulated at the return valve (107).

Thus, although there have been described particular embodiments of the present invention of a new and useful An Epoxy Grout Plant, it is not intended that such references be construed as limitations upon the scope of this invention except as set forth in the following claims.

What is claimed is:

1. An polymer grout plant that provides a temperature controlled mixing, batching, pumping, and delivery system for distributing and placement of a multiple component polymer grout having a filler additive, the polymer grout mixing device comprising:

a frame;

at least two premixing containers and two batching containers attached to the frame, each batching container including a floor and a distribution opening spaced from the floor for the removal of the individual components and filler of the polymer;

a pump assembly operatively attached to the batching containers to transport the components and filler of the polymer from the mixing containers; a conduit between each distribution opening and the pump assembly wherein the conduit includes an upward slope from the distribution opening to the pump assembly; and a heated, motion damped, neutral buoyant distribution system operatively attached to the pump assembly for combining the polymer components and distributing the polymer.

2. The polymer grout plant device of claim 1, wherein the pump assembly further includes two cylinders, each cylinder including a pump intake.

3. The polymer grout plant device of claim 2, wherein each cylinder further includes reinforced cylinder walls positioned to allow operation of each cylinder at a pressure greater than 1200 pounds per square inch.

4. The polymer grout plant device of claim 3, wherein each cylinder further includes a sealing system including numerous separate seals positioned within the cylinder to allow operation of each cylinder at a pressure greater than 1200 pounds per square inch.

5. The polymer grout plant device of claim 2, wherein the pump assembly includes a quick release attachment operatively fastening each pump intake to one of the distribution openings.

6. The polymer grout plant device of claim 5, wherein the pump assembly is rotatively attached to the frame.

7. The polymer grout plant device of claim 1, wherein the angle of the slope ranges from fifteen degrees to sixty degrees.

8. The polymer grout plant device of claim 1, wherein each batching container includes a drain opening positioned in the floor for the removal of one of the components and the filler from the mixing container.

9. The polymer grout mixing device of claim 1, wherein the mixing and batching containers are positioned substantially horizontally adjacent to each other.

10. The polymer grout plant device of claim 9, further including a temperature control system operatively engaging each mixing container and delivery umbilical to maintain the components in each mixing container at a predetermined temperature and viscosity.

11. The polymer grout plant device of claim 10, wherein the temperature control system includes a fluid filled chamber substantially surrounding each mixing container and delivery umbilical.

12. The polymer grout plant device of claim 11, wherein the temperature control system includes a thermostatically controlled heating element regulating the fluid temperature.

13. The polymer grout plant device of claim 1, wherein the distribution system further includes a static mixer operationally positioned after the pump assembly and a distribution guide operationally positioned after the static mixer.

14. The polymer grout mixing device of claim 13, wherein the static mixer combines the two components and the distribution guide allows a user of the polymer grout mixing device to selectively place the polymer grout.

15. The polymer grout plant device of claim 1, wherein the pump assembly includes a return manifold positioned to selectively return the components to the batching containers.

16. The polymer grout plant device of claim 1, wherein each mixing container further includes a mixing element positioned within the mixing container to mix one of the components and the filler and maintain a negligible amount of aeration in the mixture of the one component and the filler.

17. The polymer grout plant device of claim 1, further including and air motor operatively attached to the pump assembly to operate the pump assembly.

18. The polymer grout plant device of claim 1, further including an air purifier operative attached to the air motor to remove impurities and moisture from the air used by the pump assembly.

19. The polymer grout plant device of claim 1, further including at least two preliminary mixing bins attached to the frame and positioned to transfer a mixture of one of the components and the filler to one of the batching containers.

20. A polymer grout plant device for mixing and distributing a polymer having plural components and a filler additive, the polymer mixing device comprising:

a frame;

at least two batching containers attached to the frame, each batching container including a floor and a distribution opening spaced from the floor for the removal of the individual components and filler of the polymer;

at least two preliminary mixing containers attached to the frame and positioned to transfer a mixture of one of the components and the filler to one of the batching containers;

a pump assembly operatively attached to the batching containers to transport the components and filler of the polymer from the batching containers, the pump assembly including at least one pump intake;

a conduit between each distribution opening and one of the pump intakes, wherein the conduit is inclined from the distribution opening to the pump intake; and a distribution system operatively attached to the pump assembly for combining the polymer components and distributing the polymer.

21. The polymer grout plant device of claim 20, wherein the pump assembly is rotatively attached to the frame and includes a quick release attachment operatively fastening each pump intake to one of the distribution openings.

22. The polymer mixing device of claim 20, wherein the distribution system further includes a static mixer operationally positioned after the pump assembly and a distribution guide operationally positioned after the static mixer.

23. The polymer grout plant device of claim 20, wherein the pump assembly includes a return manifold positioned to selectively return the components to the batching containers.

24. The polymer grout plant device of claim 20, further including a viscosity control system operatively engaging each mixing container to maintain the components in each mixing container at a predetermined viscosity.

25. The polymer grout plant device of claim 24, wherein the viscosity control system includes a fluid filled cavity substantially surrounding each mixing container and delivery umbilical and a thermostatically controlled heating element regulating the fluid temperature in each cavity.

* * * * *